United States Patent [19]

Fernandez

[11] Patent Number: 4,561,409

[45] Date of Patent: Dec. 31, 1985

[54] SELF-CLEANING SMOG CONTROL FILTER FOR INTERNAL COMBUSTION ENGINES

[76] Inventor: John J. Fernandez, 1620 S. Myrtle Ave., Monrovia, Calif. 91016

[21] Appl. No.: 665,173

[22] Filed: Oct. 26, 1984

[51] Int. Cl.[4] ..... F02M 25/06

[52] U.S. Cl. ..... 123/572; 123/573; 123/574

[58] Field of Search ..... 123/572, 573, 574

[56] References Cited

U.S. PATENT DOCUMENTS

| | | | |
|---|---|---|---|
| 2,198,790 | 4/1940 | Roddewig | 123/574 |
| 3,494,339 | 2/1970 | Fernandez | 123/573 |
| 4,291,660 | 9/1981 | Molyneaux | 123/574 |
| 4,373,499 | 2/1983 | Bendig | 123/574 |

*Primary Examiner*—Ronald H. Lazarus

[57] ABSTRACT

A smog control system for automotive internal combustion engines has a self-cleaning smog control filter including a movable coil spring filter inside a housing. The filter is connected to the engine crankcase in combination with an air filter connected to the carburetor induction system to recycle all gaseous fuels from the engine crankcase through the filter and back to the engine to prevent non-combustible matter from entering the exhaust manifold of the engine and being discharged to the atmosphere. The device includes means for applying tension to the top of the coil spring filter to maintain a preset filtering space between adjacent filter coils during the life of the filter. An inertial lever arm connected to the coil spring filter senses acceleration and deceleration of the vehicle to rotate the filter about its axis for producing a self-cleaning action. In addition, this rotation of the coil spring filter during vehicle motion also is limited in opposite directions by internal stops within the filter housing which limit rotation of the coil spring filter independently of the positional setting of the inertial arm that senses vehicle motion.

11 Claims, 3 Drawing Figures

SELF-CLEANING SMOG CONTROL FILTER FOR INTERNAL COMBUSTION ENGINES

FIELD OF THE INVENTION

This invention relates to techniques for reducing air pollution from the exhaust systems of internal combustion engines, and more particularly to a self-cleaning smog control filter to replace the positive crankcase ventilation (PCV) valve in the emission control systems commonly used on motor vehicles.

BACKGROUND OF THE INVENTION

In recent years, internal combustion engines used in motor vehicles have been equipped with emission control systems to prevent non-combustible matter from entering the exhaust manifold of the engine and being discharged to the atmosphere. Such engines are commonly equipped with a PCV valve which draws fumes from the crankcase and recirculates it through the engine. The PCV value has a number of disadvantages. Its opening is not adjustable to compensate for the need for an increasing flow of fumes from the crankcase as the vehicle becomes older, and therefore it often does not provide proper ventilation. The PCV valve also does not separate engine oil from the crankcase fumes being recirculated through the engine. Oil in the fumes from the crankcase mixing with the engine gasoline supply at the base of the carburetor can have the effect of reducing gasoline octane. The result is reduced horsepower and lower gasoline mileage. Oil carried with recirculating crankcase fumes causes increased oil consumption and smoke emission from the tail pipe. The PCV value also needs cleaning and replacing to maintain a reasonable level of reliability.

My U.S. Pat. No. 3,494,339 decribes a self-cleaning smog control filter in an induction system for recycling crankcase fumes through an internal combustion engine to reduce air pollution from the exhaust system of the engine. The self-cleaning smog control filter includes a wire coil spring in a filter connected to the engine crankcase in combination with the air filter connected to the carburetor induction system. All gaseous fuels are recycled from the crankcase through the engine to prevent non-combustible matter from entering the exhaust manifold of the engine. The self-cleaning smog control filter and induction system as a number of advantages over the PCV crankcase value. The filter does not need cleaning or replacing; and it separates oil from the crankcase fumes and returns the oil to the crankcase, permitting the gas and other combustible elements to recirculate through the combustion system. It does not have the effect of lowering octane or engine performance level. The filter also provides proper crankcase ventilation through different sized orifices which allow all crankcase fumes (blow-by gas) to be drawn into the intake manifold independent of engine life. The filter provides a substantial reduction in hydrocarbon and carbon monoxide exhaust emissions.

The present invention is an improvement to the self-cleaning smog control filter described in U.S. Pat. No. 3,494,339. The self-cleaning smog control filter described in that patent includes a rotating lever arm rigidly affixed to the coil spring filter. An inertial weight at the end of the lever arm senses acceleration and deceleration of the vehicle and rotates the lever arm which, in turn, rotates the coil spring filter during use. Rotation of the coil spring filter provides a means for self-cleaning the filter as well as responding to the motion of the vehicle to regulate the flow of vapors through the filter. The lever arm rotates between external stops on the filter housing to limit the winding and unwinding motion of the coil spring filter.

There is a need to ensure that a preset amount of filtration can be produced by such a coil spring filter, and that this amount of filtration can be reliably maintained during the life of the vehicle. If the coil spring filter becomes too slack, for example, then proper filtration is prevented and the vehicle's performance level is diminished. There is also a need to ensure that the restrictions on maximum winding and unwinding of the coil spring filter during use are accurately controlled and maintained throughout the life of the vehicle.

SUMMARY OF THE INVENTION

Briefly, the self-cleaning smog control filter of this invention recycles gaseous fluid through the combustion system of an internal combustion engine. One embodiment of the smog control filter includes a filter housing having a hollow interior and a coil spring filter secured within the hollow interior of the housing. A cap is rigidly affixed to the top of the coil spring filter for closing a filtration chamber within the interior of the coil spring. Adjacent coils of the coil spring are engaged by spacing means for establishing a pre-set separation space between adjacent coils of the filter for filtering gaseous fluids passing through the filter coils from the filtration chamber within the coil spring filter. A shaft secured to the coil spring filter extends to the exterior of the housing, and axial tension is maintained on the shaft to uniformly set the circumferential spacing between adjacent coil springs of the filter. Such tension is maintained on the shaft by a tension member engaged with the shaft and rigidly affixed to the housing for holding a preset tension on the shaft to maintain the preset micro filtration spacing between adjacent filter coils.

In one embodiment, an inertial arm secured to the shaft rotates the shaft in response to vehicle motion for rotating the coil spring filter through an angle about its axis. Stop means inside the housing interior and on the filter coil limit the angle through which the coil spring can rotate under inertia sensed by the inertial arm.

The adjusted tension on the coil spring filter maintains a uniform preset micro filtration space throughout the life of the filter. The spacing between adjacent filter coils during rotation of the coil spring in either direction is preset by the combination of the adjusted tension and the stop means within the filter so that a regulated filtration range during operation of the engine can be constantly maintained. Thus, a preset micro filtration can be established for normal operating conditions of the engine and for controlling filtration during operation of the vehicle. Changes in crankcase pressure and the intake manifold pressure can produce regulated filtration within known preset limits throughout the life of the vehicle. The filter also has a significant advantage in being adapted for easy installation in the space available on different automobile engines, without affecting the function of the filter. These advantages are provided in addition to the advantages of the self-cleaning filtration, separation of oil from crankcase fumes, and adjustable orifice sizes depending upon the type of automobile on which the filter is used. Increases in vehicle performance and reduced exhaust also are provided.

These and other aspects of the invention will be more fully understood by referring to the following detailed description and the accompanying drawings.

DRAWINGS

DETAILED DESCRIPTION

Figure 1:
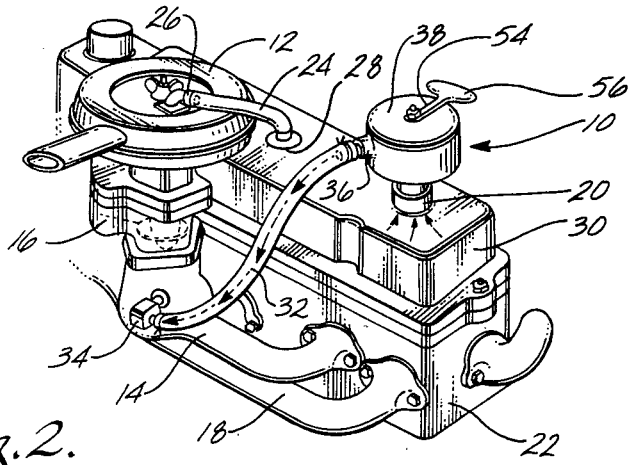
FIG. 1 is a perspective view illustrating an internal combustion engine with an emission control system having a self-cleaning smog control filter of this invention.

Referring to FIG. 1, a self-cleaning smog control filter 10 according to principles of this invention replaces the usual PCV combustion valve in an engine having an air filter 12, an intake manifold 14, a carburetor 16, and an exhaust manifold 18. The smog control filter 10 is mounted on the breather or vent pipe opening in the engine crankcase 22. A hose 24 is connected at one end to the carburetor inlet 26 and at its opposite end to an opening 28 in the top of the valve cover 30. A return conduit 32 is connected at one end to a fitting 34 entering into the intake manifold 14 near the base of the carburetor. The return conduit 32 is connected at its opposite end to an exit opening fitting 36 of the smog control filter 10. Thus, the system provides a closed recycling system for crankcase gases, with an intermediate link being formed between the engine crankcase and the carburetor induction system to recycle crankcase exhaust gases as described below.

Figure 2:
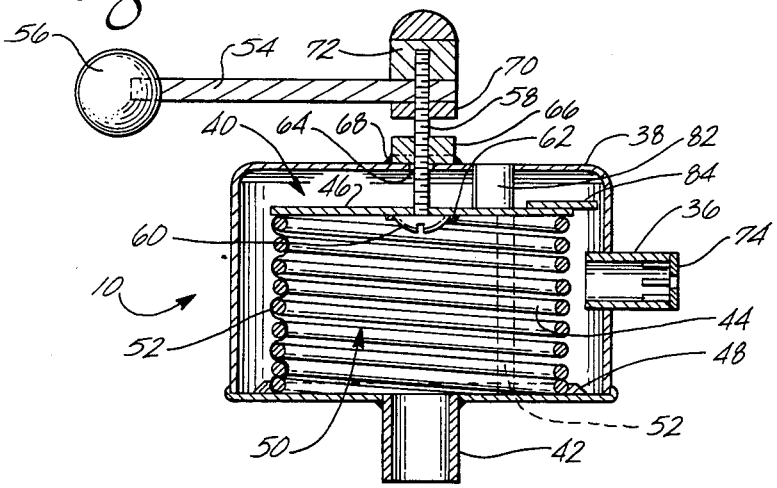
FIG. 2 is a cross sectional view of the smog control filter.

The smog control filter is understood best by referring to FIG. 2. The filter includes a housing 38 having a hollow interior 40. The exit port 36 opens through a side wall of the housing. A central supporting conduit 42 opens through the bottom center of the housing. A coil spring filter 44 is mounted in an upright position in the hollow interior of the housing and is centered over the central supporting conduit 42 at the base of the housing. The coil spring filter, in one embodiment, is a two-inch diameter coil spring made of carbon steel wire 0.062 inch in diameter. In the preferred embodiment, the ends of the coil spring are 180 degrees apart, and there can be 12½ to 16½ coils to provide the desired spring tension. The coil spring illustrated in FIG. 2 is in exaggerated form with the spacing between adjacent coils being shown much wider than in actual use, for clarity. The top of the coil spring is closed by a cap 46 to which the top of the coil is rigidly attached, as by soldering or welding, to form a pressure-tight seal at the top of the spring. The bottom of the coil spring is rigidly affixed to the inside bottom wall of the filter housing by welding 48 to seal the bottom of the filter coil to the housing around the passage through the central conduit 42. The inside of the coil spring thus forms a sealed internal filtering chamber 50 surrounding the bottom conduit 42 so that gaseous fluids entering the interior of the filtering chamber 50 through the passage in the conduit 42 can only escape the filter through the spacing provided between adjacent filter coils.

In one embodiment, the coils are separated by a number of ribbon spacers or shims 52 of sufficient thickness to provide space for crankcase gases to pass through the filter. In the illustrated embodiment, there are preferably three such ribbon spacers spaced approximately 120 degrees apart around the perimeter of the coil spring. Each ribbon spacer is a thin strip of stainless steel foil, and in one embodiment the ribbon thickness is about 0.001 inch (25 microns) in thickness. Each ribbon spacer extends vertically through the coil and alternately passes around the exterior of one coil and around the interior of the adjacent coil in the manner illustrated in FIG. 2. The ribbon spacers set the minimum micro filtration spacing between adjacent coils of the coil spring filter. The ribbon spacers can be changed to different thicknesses for varying the nominal micro filtration space provided by the filter.

The coil spring 44 is rotatable about its vertical axis by an inertial lever arm 54 having a lead weight 56 at its end for sensing acceleration and deceleration of the vehicle. The lever arm is affixed to an upper portion of an upright externally threaded shaft 58 extending to an elevation above the top of the housing 38. The shaft 58 has a head 60 rigidly affixed to the face of the cap 46 inside the filtration chamber 50. The head 60 of the shaft is affixed to the inside face of the cover plate by welding 62. The shaft 58 extends through the cover plate, through the upper hollow interior portion 40 of the housing, and through an opening 64 in the top center of the housing. The opening 64 makes a loose fit around the exterior of the shaft 58 so that the shaft rotates freely in the opening 64. The shaft is threaded through an internally threaded tension nut 66 at the top center of the housing. The tension nut is rigidly affixed to the exterior of the upper wall of the housing by welding 68. Spaced above the tension nut 66 are fastening means for rigidly affixing the lever arm 54 to the top portion of the shaft. This includes an internally threaded shear nut 70 threaded onto the shaft and tightened against the bottom of the lever arm, and a cap nut 72 having an internally threaded section threaded onto the top of the shaft 58 and tightened against the upper face of the lever arm. The angular position of the lever arm can be adjusted by loosening the shear nut, or the cap nut, or both, and by rotating the lever arm by hand to the proper angular orientation (described below), after which the shear nut, or cap nut, or both, are tightened against opposite faces of the lever arm to rigidly affix the lever arm in place on the shaft 58. In one embodiment, the lever arm comprises a metal bar 2½ inches long, ½-inch wide, and ⅛-inch thick. The vertical shaft 58 is a ¼-inch-diameter screw thread matching ¼-inch-diameter internal threads on the shear nut 70 and the tension nut 66 which is preferably made of brass.

The nominal spacing of the coil spring filter (the space between adjacent coils) is set by a combination of the thickness of the ribbon spacers 52 and an amount of tension applied to the top of the filter through the tension nut 66. With the tension nut 66 loosened, the top of the filter can be pulled upwardly by applying an upward pulling force to the shaft 58 to widen the space between adjacent coils. Likewise, the filter spacing can be minimized by downward pressure on the shaft 58.

In setting the nominal spacing for the coil spring filter, downward pressure applied to the top of the shaft 58 holds the coil spring filter at its minimum open position. The tension nut 66 is then nominally tightened against the top of the housing and then turned ¼ of a rotation further which sets the filter spacing to a 25-micron width uniformly around the circumference of the filter coils. (Tightening the tension nut against the top of the housing, for a left-hand screw thread on the shaft 58, lifts the shaft and the cap 46 of the filter to increase the spacing between the filter coils.) After the desired spacing is provided, the tension nut is welded to the housing by the weld 68 to hold the tension nut in place to maintain the upward tension on the top of the cover 46, which maintains the uniform micro filtration spacing set by the tension nut. The ribbon spacers 52 also provide the minimum 25-micron filter spacing, but the upward tension provided by cooperation between the shaft 58 and the tension nut setting stabilizes the spacing to provide uniform spacing around the entire circumference of the coil spring filter.

A snap-on orifice 74 is releasably fastened to the opening in the entrance port 36. Snap-on orifices having openings of different sizes can be readily changed to balance and assist in maintaining the air-to-fuel ratio in the intake manifold so as to obtain maximum performance of the engine under all operating conditions. The snap-on orifices can vary in diameter from about 3/32 inch in increments of 1/32 inch up to an orifice diameter of about ¼ inch.

Figure 3:
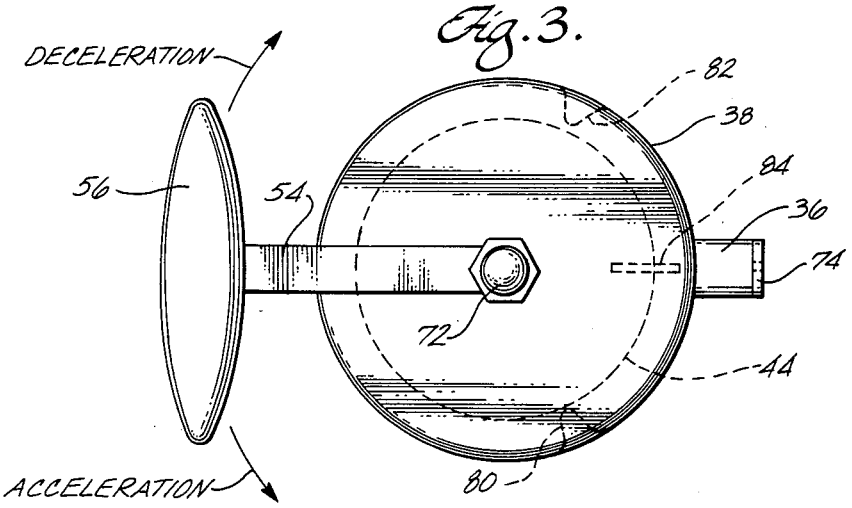
FIG. 3 is a top view of the smog control filter shown in FIG. 2.

The coil spring filter is rotated through an angle in forward or reverse directions, illustrated by the arrows in FIG. 3, in response to acceleration or deceleration of the vehicle. Rotation of the coil spring filter is restricted to maximum angular travel of both directions by fixed stops 80 and 82 affixed to the inside wall of the housing and a stop pin 84 rigidly affixed to the cover plate 46 of the coil spring. Under rotation of the coil spring in either direction, the stop pin 84 engages either the stop 80 or the stop 82 to limit further angular travel of the coil spring. The normal unbiased position of the coil spring centers the stop pin 84 between the two internal stops 80 and 82.

Use of the self-cleaning smog control filter 10 will be described in relation to its use as a replacement for the normal PCV smog control valve. The conduit 32 normally connected to the PCV valve is disconnected, in which case the engine should stop running. The PCV smog control unit is replaced with the smog control filter of this invention. If there is a fitting 34 on the intake manifold, the fitting should be removed and checked to ensure that its passage has at least a ¼-inch diameter. If it is smaller than ¼-inch in diameter, the hole must be drilled and tapped to ¼-inch diameter. The valve cover 30 is then removed and two ½-inch diameter holes are drilled in the top of the valve cover. One hole is for securing the fitting 42 at the base of the smog control filter to the valve cover. The other hole is for installation of a similar fitting to which the bypass hose 24 is attached. The other end of this bypass hose is connected to the carburetor air cleaner. Hole locations are chosen so as to not interfere with valve tappets and to allow for free and easy access to the bypass hose. The threaded pipe fitting 42 at the base of the smog control filter is attached to the second hole in the top of the valve cover so the bottom of the fitting extends through the valve cover only far enough that the fitting can be firmly attached for communication with the crankcase interior. The valve cover is then replaced. The proper size for the valve orifice 74 is then selected. Smaller orifices are for small engines, and larger orifice sizes are for larger engines. To choose the correct orifice, the oil cap is removed, and if oil is not being pushed through the opening, the palm of the hand is placed over the opening. It is observed whether there is a pull (vacuum) or push (pressure) on the palm of the hand. Correct orifice size should produce a slight vacuum pull on the palm of the hand when the hand is placed over the oil cap opening while the engine is running. Vehicles pushing oil or smoking from the tail pipe need a larger opening and may need the idling speed adjusted after installation. The lever arm 54 is then moved to its correct position by loosening the cap nut 72 and then rotating the lever relative to the shaft 58 so the lever extends across the engine (90 degrees to the long axis of the engine), after which the cap nut is tightened to hold the lever arm in place. This positioning of the lever am makes it possible for the lead weight 56 on the inertial arm to sense acceleration or deceleration of the vehicle. The position of the lever arm shown in solid lines in FIG. 3 is for normal operating conditions of the engine. The lever arm rotates in the directions of the arrows in FIG. 3 during acceleration or deceleration of the vehicle. The smog control filter housing and filter can be positioned on the engine in any rotational position independently of the position of the lever arm. In many cases the space in which the filter is positioned is crowded, so the filter is first positioned to properly fit into the available space, after which the lever arm is adjusted to a position extending at a right angle to the long axis of the engine. Inasmuch as the stops 80 and 82 control the angular rotation of the coil spring filter independently of contact with the lever arm, the stops always provide limits on angular rotational travel of the filter during use, independently of their position on the vehicle. Once the lever arm is in the proper position, the coil spring filter will always move between its stop limits under acceleration or deceleration of the vehicle.

During use of the self-cleaning smog control filter, the coils of the coil spring filter are separated by a sufficient distance to provide space for crankcase fumes to pass through the filter from the entrance port 42. The fumes pass through the exit port 36 and through the return hose 32 to the intake manifold for further combustion. Any accumulated non-combustible fluid or solid matter does not pass through the filter, but is returned to the crankcase oil reservoir for disposal in the usual manner. The start, stop and accelerating motion of the vehicle cause a self-cleaning back and forth movement of the lever arm, which causes the spring coil filter to twist back and forth about its vertical axis. Since motor fuels contain some forms of gums or resins which deposit a sticky residue upon being burned in an internal combustion engine, a constant accumulation of the residue could clog this or any other filter, but the spring walls of the filter undergo a forcible twisting movement under the inertial lever arm which produces a self-cleaning action. The smog control filter also regulates and maintains the desired fuel-air ratio for complete fuel combustion. Since the inertial lever arm responds to motion of the vehicle during acceleration and deceleration, desired filtering is obtained during these times as well as normal operation of the vehicle. For instance, the intertial lever arm is set so that it rotates under acceleration of the vehicle to twist the coil spring filter so as to loosen it, permitting greater flow of gases through the filter at a time when there is less vacuum produced because of operation of the accelerator. This movement of the coil spring filter makes it easier to pull the fumes through the coil than if the filter remained stationary. On the other hand, during normal operation when the butterfly valve of the carburetor is closed, there is more vacuum available to pull the fumes through the filter, and at this time, the spacing between the spring coils is smaller.

Thus, the self-cleaning smog control filter of this invention provides a reliable means for accurately controlling the amount of filtering available during operation of the vehicle. The filter provides means for precisely setting the amount of filtering initially, for maintaining the preset amount of filtering during the life of the vehicle, and for accurately and reliably limiting automatic changes in filtering during operation of the vehicle.

What I claim is:

1. A self-cleaning smog control filter for recycling gaseous fluids through the combustion system of an internal combustion engine, the smog control filter comprising a filter housing having a hollow interior, coil spring filter means secured within the hollow interior, closure means on the coil spring filter means for closing a filtration chamber within the interior of the coil spring filter means, the coil spring filter coils having a separation space between them for filtering gaseous fluids passing through said separation space from the interior of the coil spring filter, a shaft secured to the coil spring filter means and extending to the exterior of the housing so that axial tension on the shaft provides a preset amount of spacing between adjacent coils springs of the filter, an inertial arm secured to the shaft for rotating the shaft for twisting the coil spring filter about its axis in opposite directions, tension setting means engaged with the shaft and holding a preset tension on the shaft to maintain a preset micro filtration space between the filter coils, stop means inside the housing interior and cooperating with the filter coil for limiting the angle of rotation through which the filter coil can rotate under inertial sensed by the inertial arm, an entry port to the filtration chamber inside the coil spring filter for receiving gaseous fluids from the engine crankcase, and an exit port through the housing for passing filtered gaseous fluids to the intake manifold of the engine.

2. Apparatus according to claim 1 including means for engaging the coil spring filter coils for establishing a minimum spacing between adjacent coils of the filter.

3. Apparatus according to claim 1 in which the means for closing the filter chamber comprises a cap rigidly affixed to the top of the coil spring filter, and in which the shaft is a threaded shaft rigidly affixed to the cap; and the tension setting means comprises a tension nut threaded onto the shaft and tightened against the housing to hold tension on the shaft.

4. Apparatus according to claim 3 including means rigidly affixing the tension nut to the housing so the shaft rotates relative to the fixed tension nut.

5. Apparatus according to claim 1 including means for rotating the inertial arm relative to the shaft and the spring, and means for cooperating between the shaft and the inertial arm to fasten the arm against rotation relative to the shaft.

6. A self-cleaning smog control filter for recycling gaseous fluids through the combustion system of an internal combustion engine, the smog control filter comprising a filter housing having a hollow interior, coil spring filter means secured within the hollow interior, closure means on the coil spring filter means for closing a filtration chamber within the interior of the coil spring filter means, the coil spring filter coils having a separation space between them for filtering gaseous fluids passing through said separation spece from the filtration chamber within the coil spring filter means, a shaft secured to the coil spring filter means and extending on to the exterior of the housing so that axial tension the shaft provides a present spacing between adjacent coil springs of the filter, an inertial arm secured to the shaft for rotating the shaft for twisting the coil spring filter about its axis in opposite directions, tension setting means engaged with the shaft and holding a preset tension on the shaft to maintain a preset filtration space between the filter coils, an entry port to the filtration chamber inside the coil spring filter for receiving gaseous fluids form the engine crankcase, and an exit port through the housing for passing filtered gaseous fluids to the intake manifold of the engine.

7. Apparatus according to claim 6 including means for engaging the coil spring filter coils for establishing a minimum spacing between adjacent coils of the filter.

8. Apparatus according to claim 7 in which the closure means comprises a cap rigidly affixed to the top of the coil spring filter, and in which the shaft is a threaded shaft rigidly affixed to the cap; and the tension setting means comprises a tension nut threaded onto the shaft and tightened against the housing to hold tension on the shaft.

9. Apparatus according to claim 8 including means rigidly affixing the tension nut to the housing so the shaft rotates relative to the fixed tension nut.

10. Apparatus according to claim 6 in which the closure means comprises a cap rigidly affixed to the top of the coil spring filter, and in which the shaft is a threaded shaft rigidly affixed to the cap; and the tension setting means comprises a tension nut threaded onto the shaft and tightened against the housing to hold tension on the shaft.

11. Apparatus according to claim 10 including means rigidly affixing the tension nut to the housing so the shaft rotates relative to the fixed tension nut.

* * * * *